US006093008A

United States Patent [19]

Kirsten

[11] Patent Number: 6,093,008

[45] Date of Patent: Jul. 25, 2000

[54] WORM-DRIVE COMPRESSOR

[76] Inventor: Guenter Kirsten, Erzbergerstrasse 13, D-08451 Crimmitschau, Germany

[21] Appl. No.: 08/973,167

[22] PCT Filed: May 18, 1996

[86] PCT No.: PCT/EP96/02078

§ 371 Date: Nov. 19, 1997

§ 102(e) Date: Nov. 19, 1997

[87] PCT Pub. No.: WO96/37706

PCT Pub. Date: Nov. 28, 1996

[30] Foreign Application Priority Data

May 25, 1995 [DE] Germany ..... 195 19 247

[51] Int. Cl.[7] ..... F01C 1/16

[52] U.S. Cl. ..... 418/201.1; 418/200

[58] Field of Search ..... 418/200, 201.1

[56] References Cited

U.S. PATENT DOCUMENTS

| | | | |
|---|---|---|---|
| 4,259,045 | 3/1981 | Teruyama | 418/200 |
| 5,496,163 | 3/1996 | Griese et al. | 418/200 |
| 5,549,463 | 8/1996 | Ozawa | 418/200 X |

FOREIGN PATENT DOCUMENTS

| | | | |
|---|---|---|---|
| 470400 | 12/1950 | Canada | 418/200 |
| 609405 | 2/1935 | Germany . | |
| 1954738 | 7/1966 | Germany . | |
| 1428125 | 11/1968 | Germany . | |
| 84891 | 10/1971 | Germany . | |
| 2520667 | 11/1976 | Germany . | |
| 2621303 | 11/1976 | Germany . | |
| 3031801 | 3/1981 | Germany . | |
| 3813272 | 11/1988 | Germany . | |
| 4227332 | 2/1993 | Germany . | |
| 4316735 | 11/1994 | Germany . | |
| 4403649 | 8/1995 | Germany . | |
| 397937 | 3/1960 | Switzerland . | |
| 342791 | 2/1931 | United Kingdom . | |
| 650606 | 2/1951 | United Kingdom . | |
| 2254376 | 10/1992 | United Kingdom | 418/200 |

*Primary Examiner*—Hoang Nguyen
*Attorney, Agent, or Firm*—Diller, Ramik & Wight, PC

[57] ABSTRACT

The invention relates to a worn-rive compressor (10) with a main rotor shaft (18) on which are fitted at least one first and one second main rotor (14, 16), each of which meshes with a matching first or second sub-rotor (20, 22) on a rotor layshaft (24). To provide a hard-wearing, economically produced and highly efficient worm-drive compressor (10), the hearings of the rotor main and layshafts (18, 24) are matched to the compressed gas supply in such a way that the loads imposed on the shafts by the pressures produced are absorbed by radially operating bearings (40, 42, 44, 47) near the point at which they arise.

24 Claims, 5 Drawing Sheets

WORM-DRIVE COMPRESSOR

BACKGROUND OF THE INVENTION

The invention relates to a screw-type compressor with a primary rotor assembly shaft on which at least a first and a second primary rotor are arranged, respectively meshing with a matching first and second secondary rotor on a secondary rotor assembly shaft.

To compress gaseous matter such as air and to make it available as compressed gas, screw-type compressors are used. These screw-type compressors must be adapted to the operative conditions of the gas to be compressed, it being of particular importance to provide the gas in a desired amount and with a desired pressure. Moreover, requirements concerning the purity of the gas are often made so that oil lubrication may sometimes be undesirable.

The amount of compressed gas and the gas pressure obtainable with the screw-type compressor depend on the rotor geometry of the rotors used in the screw-type compressor and the rotational speed of the rotors. However, it has been found that due to the peripheral velocities occurring at the rotor circumference and due to sealing problems between the rotors of a screw-type compressor stage, the possibilities of increasing the rotational speed and the rotor diameter are limited.

To avoid restrictions in the amount of compressed gas delivered by the screw-type compressor, one has developed screw-type compressors with double-helical gearing having two rotors on the primary rotor assembly shaft and the secondary rotor assembly shaft, respectively, with which the amount of compressed gas delivered by the screw-type compressor could be increased.

Such a double-screw compressor is known from DE 30 31 801 A1. This screw-type compressor has primary rotors with leftward and rightward helical screws, arranged on a common shaft adjoining each other at the end faces in a joining plane and meshing with corresponding leftward and rightward helical secondary rotors also arranged on a common shaft and adjoining each other at the end faces. In this screw-type compressor, the gaseous medium to be compressed is transported to the center of the screw-type compressor, from where it is let out in the radial direction. To avoid the effect known as the "enclosed pocket" and to guarantee a good transport of the compressed gas, the two rotor pairs are angularly offset with respect to each other so that the enclosed pocket of the one rotor pair that is forming may be vented into the still open helical groove of the trailing opposite rotor pair. Since the rotor pairs abut at their centers, the primary and secondary rotor assembly shafts are each supported at their opposite outer ends.

However, due to the overflow of the compressed gas, the known screw-type compressor has an unsatisfactory efficiency. Moreover, the supporting of the primary and secondary rotor assembly shafts is expensive, since the forces occurring at the rotors cause a complex load characteristic of the primary and secondary assembly rotor shaft, both in the radial and the axial directions, resulting in high wear.

SUMMARY OF THE INVENTION

It is the object of the present invention to provide a long-wearing screw-type compressor that may be produced with little effort and has a high efficiency.

The object is solved, according to the invention, with the features of each of claims 1, 4 and 13.

According to the invention, the wear of the screw-type compressor is reduced by adapting the bearing of the primary and secondary rotor assembly shafts such to the way of the compressed gas transport that the loads on the shafts, caused by the pressures occurring, are accommodated by radially acting bearings near their place of origin. By this manner of bearing, stricter tolerances may be selected so that a higher efficiency can be obtained. The present manner of bearing further is advantageous in that the effort for the bearing is reduced, whereby the screw-type compressor can be made at lower cost.

The number of rotors per shaft is not limited. Basically, three and more rotors could be provided. However, if two rotors are provided, they are preferably spaced axially from each other. The axial distance between the rotors makes it possible to support both the primary rotor assembly shaft and the secondary rotor assembly shaft in the area between the primary rotors and the secondary rotors so that, when carrying off the compressed gas in the area between the rotors, the forces generated can also be taken up in this area. When the compressed gas is carried off at the outer front end faces of the rotor pairs and thus the greatest forces occur there, the bearing is suitably provided at the outer front faces of the rotor pairs.

According to a preferred embodiment of the invention, the rotor geometries of the primary rotors are adapted to each other such that the forces of the compressed gas of the two primary rotors acting in the axial direction cancel each other at least partly, preferably completely. The compensation of the compressed gas forces acting in the axial direction, which results from the surfaces active in the axial direction and from the pressure on the respective surface, has the effect that the wear on the primary rotor assembly shaft and the bearing effort for the same are reduced.

By a mirror symmetric design of the two primary rotors, it is achieved that the structural effort in designing rotors is reduced. An arrangement of two mirror symmetric primary rotors without mutual angular offset and exactly in phase on the primary rotor assembly shaft guarantees that also the course of the pressure in time that changes with every new angular position of the rotors, has no outward effect on the axial forces transmitted by the primary rotor assembly shaft so that bearings acting in the axial direction can be omitted.

Preferably, the two secondary rotors and the second primary rotor are supported at one side only. Such cantilevered bearing is advantageous in that a change in the ratio D/L (diameter/rotor length) can readily be made and in that the construction of novel screw-type compressors with altered L/D ratio, and thus an altered absorption volume, does not require the design of novel rotor geometries, since the cantilevered rotors may readily be shortened. If, however, the secondary rotors and the second primary rotor each have their outer end faces provided with a bearing opening for receiving bearing bushings, greater forces can be accommodated by additional simple and low cost bearings at the end faces so that the screw-type compressor can be operated at higher pressures.

By virtue of an adjustment device arranged in the secondary rotor assembly shaft for adjusting the axial distance of the two secondary rotors, the secondary rotors can be made independent from each other and from the primary rotors, the play between the primary rotor assembly shafts and the respective secondary rotor being adjustable posteriorly by means of the adjusting device. This structure not only reduces the production effort, but it also minimizes the return blow losses occurring during the operation of the screw-type compressor, since smaller tolerances can be used.

Regardless of whether the bearing of the primary rotor assembly shaft and the secondary rotor assembly shaft is realized centrally or at the front ends of the respective shaft, it is advantageous to provide a partitioning wall between two compressor stages formed by a primary rotor and a secondary rotor, respectively. By means of this partitioning wall, an uncontrolled overflow of pressure gases from one compressor stage into the other compressor stage can be prevented. Preventing the overflow is of particular advantage, if the screw-type compressor is to be operated in a kind of tandem operation, wherein the pressure medium to be compressed first flows through the first and then through the second compressor stage. In this design, it is advantageous to use water injection for cooling in the first compressor stage. In the second compressor stage, water injection is not necessary. In one embodiment of the screw-type compressor with successively flown-through compressor stages, it is advantageous to provide different rotor geometries for the first and the second compressor stages that are adapted to the respective changes in volume.

The rotors may have a 5/7 or 6/7 gearing. Larger numbers of teeth lead to an unfavorable absorption volume, and with smaller numbers of teeth, the height of the teeth becomes to great and the corresponding rotor shaft becomes too thin. The preferred 5/7 gearing of the rotors causes a compressed gas flow that pulses only weakly, generates little noise and has good strength properties.

By providing two primary rotors cast on a common integral shaft, it is achieved that the rotors are arranged without a mutual angular offset, which has a positive effect on avoiding axial forces acting outward.

Further advantageous embodiments and developments of the invention result from the dependent claims and the drawings in connection with the specification. The following is a detailed description of the invention with reference to two embodiments thereof.

DESCRIPTION OF THE PREFERRED EMBODIMENT

Figure 1:
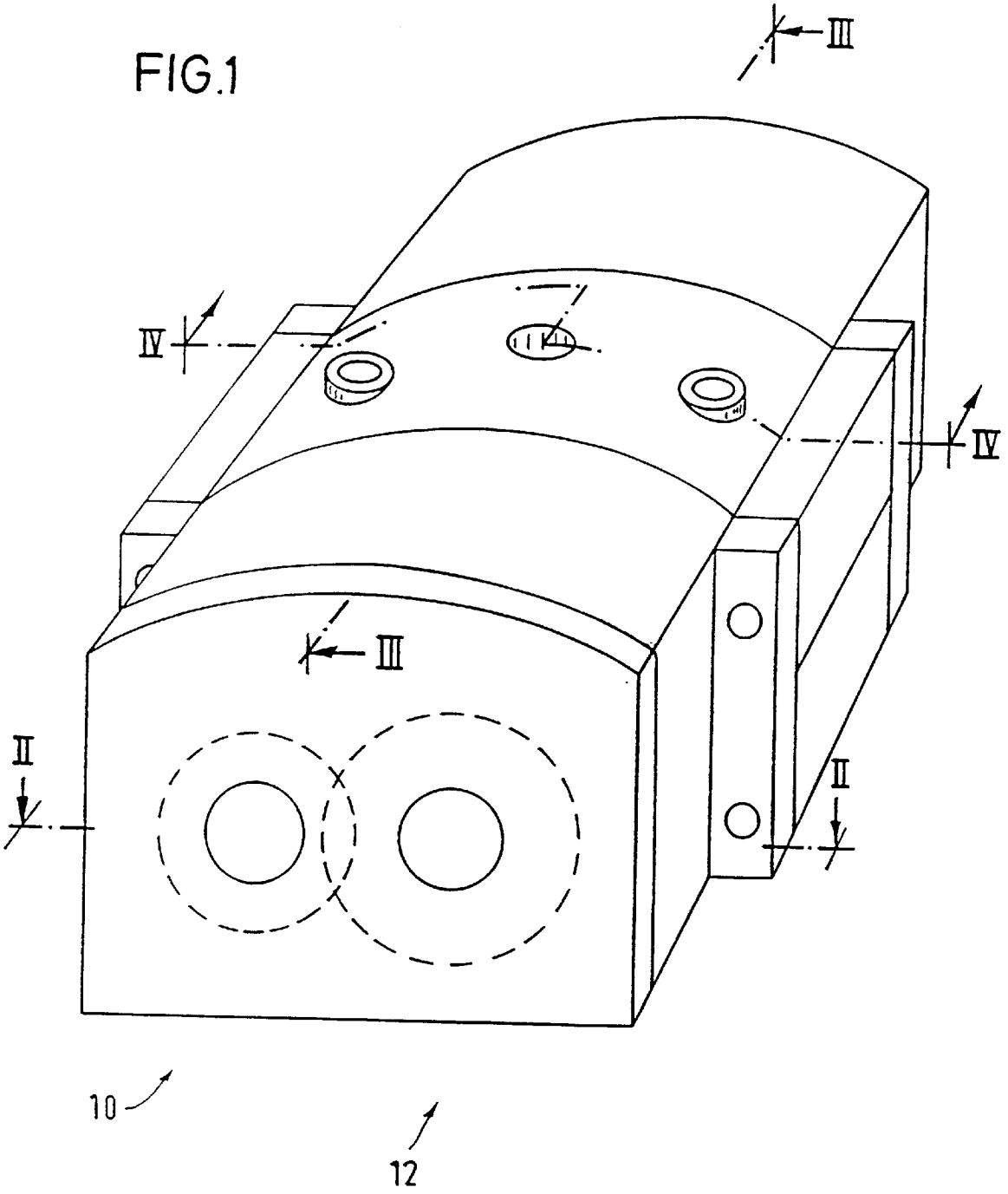
FIG. 1 is a simplified perspective view of a first embodiment of a screw-type compressor according to the present invention.
Figure 2:
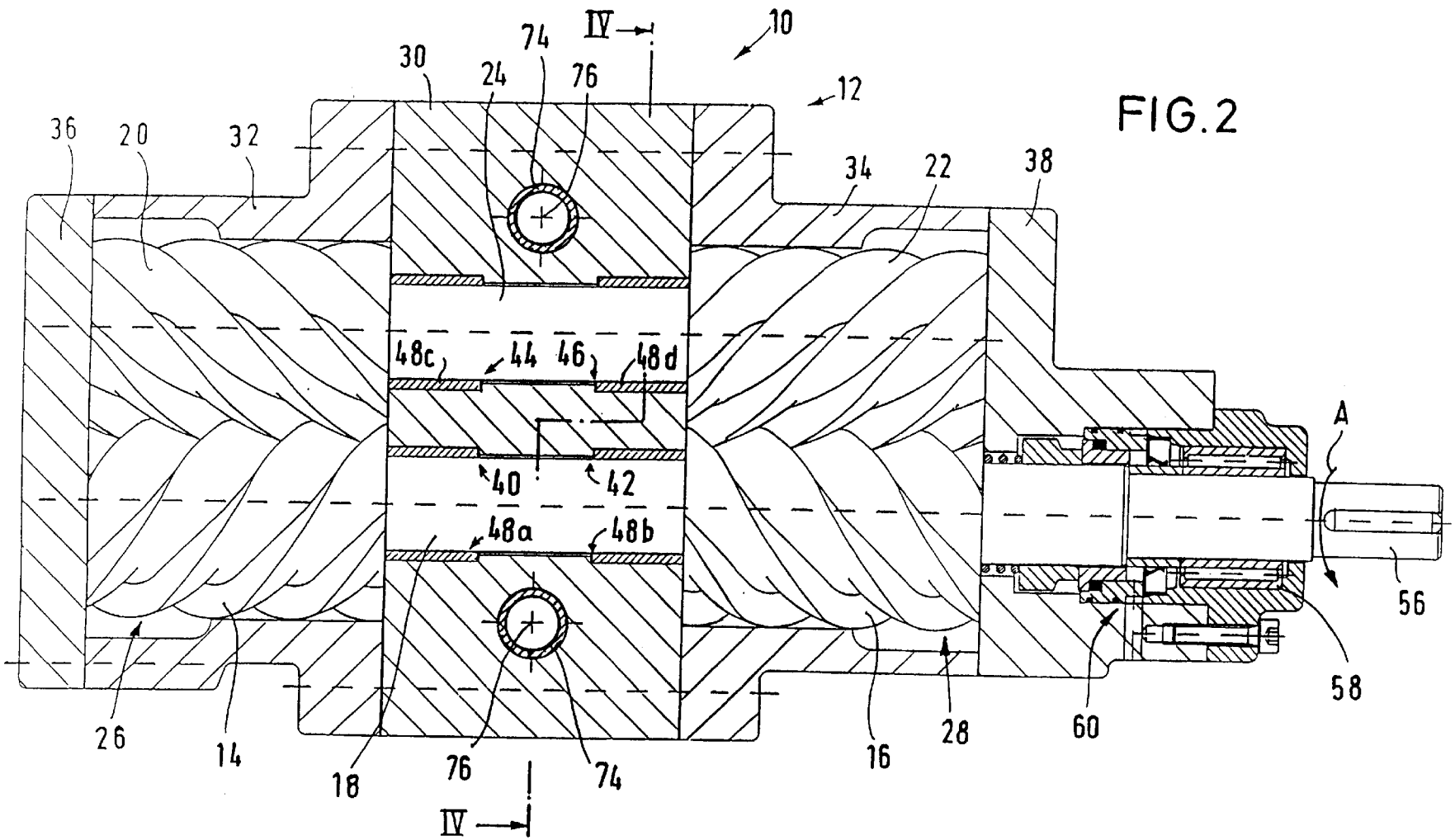
FIG. 2 is a sectional view of the screw-type compressor illustrated in FIG. 1 along line II—II in FIG. 1.

As can be seen in FIG. 2, the first embodiment of the screw-type compressor I 0 shown in FIGS. 1 to 4 comprises a housing 12 in which a primary rotor assembly shaft carrying two ceramic primary rotors 14, 16 and a secondary rotor assembly shaft carrying two ceramic secondary rotors 20, 22 are arranged. Within the housing 12 of the screw-type compressor 10, the first primary rotor 14 forms a first compressor stage 26 together with the first secondary rotor 22 arranged in parallel to a second compressor stage 28 formed by the second primary rotor 16 and the second secondary rotor 20, with respect to the pressure gas flow.

The operation of the screw-type compressor 10 is influenced by the arrangement of the two compressor stages 26, 28 in the housing 12, as well as by the kind of bearing primary rotor assembly shaft 18 and the secondary rotor assembly shaft 24, it being important to note that the housing 12 accommodating all rotors 14, 16, 20, 22 is composed of multiple parts.

The housing 12 has a central bearing block divided along the planes of the rotor axes with jacket portions 32, 34 laterally flanged thereto. The jacket portions 32, 34, the length of which respectively corresponds to the length of an associated rotor pair 14, 40, 16, 22 of the first or second compressor stage 26, 28, and which enclose the rotors of the first compressor stage 26 and the second compressor stage 28, have their outer end faces closed by a first and second end cover 36, 38, respectively. In the center of the screw-type compressor 10, the two compressor stages 26, 28 are separated from each other by the bearing block 30 acting as a partitioning wall. So-called cover flaps are formed at the jacket portions 32, 34 that are disposed on the intake side of the rotors 14, 16, 20, 22 and serve to return coolant and lubricant thrown off by the rotors 14, 16, 20, 22.

To support the primary rotor assembly shaft and the secondary rotor assembly shaft 18, 24, the bearing block 30 has two split bearings 40, 42, 44, 46 for each shaft, the lower bearing shells 48*a* to 48*d* thereof being arranged in a lower portion 50 of the bearing block, whereas the upper bearing shells 52*a* to 52*d* are arranged in an upper portion 54 of the bearing block 30. The bearing shells 48*a* to 48*d*, 52*a* to 52*d* that are provided with lubricant bores (not illustrated)for oil or water lubrication and are arranged directly adjoining the rotors, comprise the respective shaft so as to take up radial forces.

The screw-type compressor 10 is driven by a drive shaft 56 integrally formed with the primary rotor assembly shaft 18, the drive shaft projecting through the second end cover 38 at one of the end faces of the screw-type compressor 10 and being supported with respect to the end cover 38 in a needle bearing 58. In order to seal the second compressor stage 28, closed by the second end cover 38, towards the outside, a sealing arrangement 60 is provided that seals the drive shaft 56 against the housing 12.

The drive of the screw-type compressor 10 is effected by rotating the drive shaft 56 counterclockwise as indicated by the arrow A. By this rotation, the first and the second primary rotor 14, 16 cast on the primary rotor assembly shaft 18 are driven. The secondary rotors 20, 22 are driven indirectly, meshing with the primary rotors 14, 16 that are driven by the primary rotor assembly shaft 16.

Figure 3:
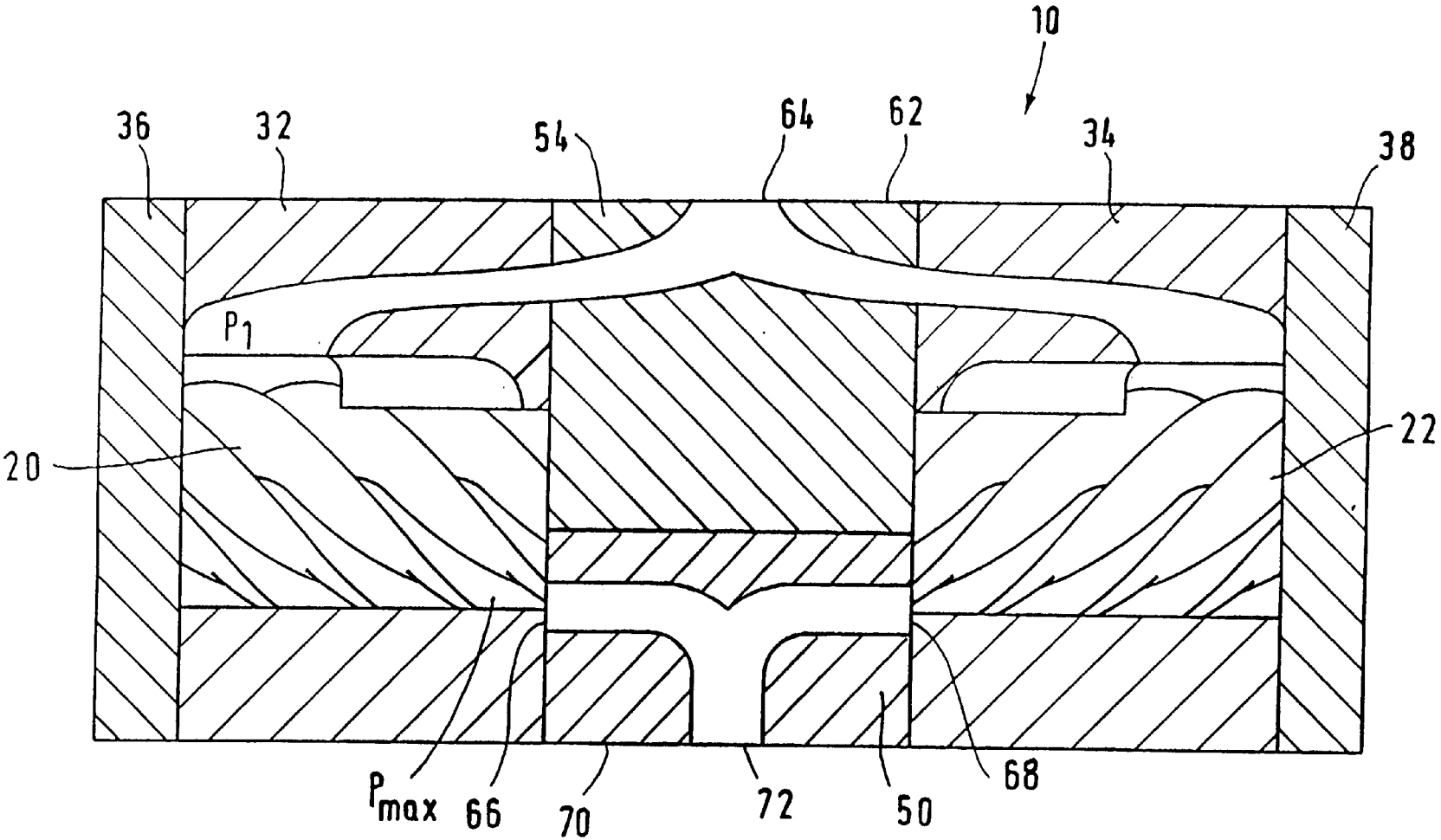
FIG. 3 is a sectional view of the screw-type compressor illustrated in FIG. 1 along line III—III in FIG. 1.
Figure 4:
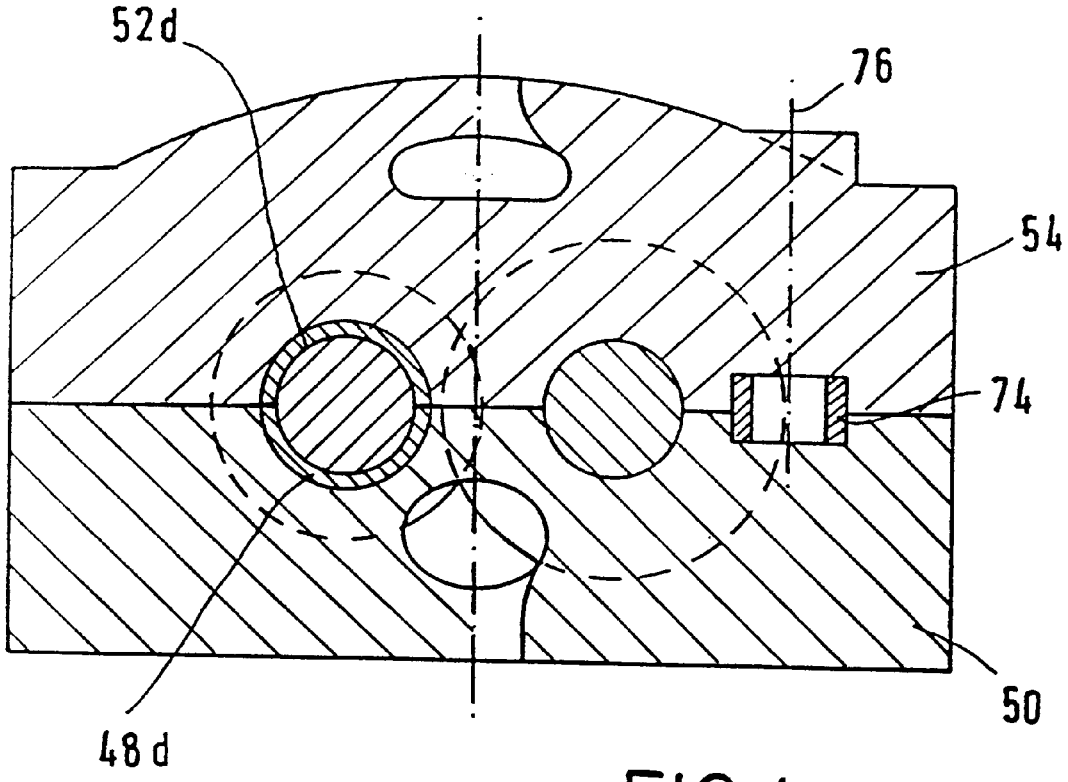
FIG. 4 is a sectional view of the screw-type compressor illustrated in FIG. 1 along line IV—IV in FIG. 1.

The conduction of the gas to be compressed may best be seen in FIG. 3. The gas to be compressed is first supplied to the screw-type compressor 10 at the top 62 of the upper portion 54 of the bearing block. This may be done either directly or indirectly through intake filters and intake coolers. From the inlet opening 64 at the top 62 of the upper bearing block portion 54, the gas is first conducted to the two end faces of the screwtype compressor 10. From the end faces of the screw-type compressor 10, the compressed gas spreads above the primary rotors and the secondary rotors 14, 16, 20, 22 forming the first and second compressor stages 26, 28. By rotating the rotors 14, 16, 20, 22 and by the meshing of the same resulting from the rotation of the rotors 14, 16, 20, 22, the air is compressed and conveyed to controlling edges 66, 68 at the lower bearing block portion 50, from where the compressed air is conducted out in the axial direction of the respective compressor stage 14, 16 and to a pressure relief opening 72 at the bottom 70 of the lower bearing block portion 50.

It is evident from FIG. 3 that at the respective upper side of the primary rotors and secondary rotors 14, 16 always only the inlet pressure (P1) prevails. However, there always is a higher pressure (Pmax) at the opposite side so that the primary rotor assembly shaft and the secondary rotor assembly shaft 18, 24 are subjected to a circulating bending load. What is more, this bending load is pulsed since the permanent opening and closing of compression chambers create pressure pulses.

To keep the pressure pulsation low, the primary rotors 14, 16 each have five teeth meshing with seven teeth of the secondary rotors 20, 22. To avoid outward acting axial forces, one of the two primary rotors 14 has a rightward helix, whereas the other primary rotor 16 has a leftward helix. The two primary rotors 14, 16 are arranged on the primary rotor assembly shaft 18 without mutual angular offset. Since both primary rotor assembly shafts 14, 16 further have equal lengths, the compressed gas forces acting on the teeth of the primary rotor assembly shaft 14, 16 cancel each other out so that the bearing of the primary rotor assembly shaft 18 does not require an axial guiding.

The screw-type compressor 10 is produced by first casting the two primary rotors 14, 16 on a prepared primary rotor assembly shaft 18. Similarly, the secondary rotors 20, 22 are cast around a prepared secondary rotor assembly shaft 24. Both shafts 18, 24 are then placed into their respective lower bearing shells 48*a* to 49*d*. Thereafter, the bearing block 30 is closed by placing the finished upper bearing block portion 54 with the bearing shells 52*a* to 52*d* arranged therein onto the lower bearing block portion 50. The centering during this positioning is done as in the finishing of the upper bearing block portion 54 and the lower bearing block portion using centering sleeves which, for centering the upper bearing block portion 54 and the lower bearing block portion 50, are provided surrounding tensioning screw means 76. The divided structure of the bearing block 30 thereby substantially facilitates the fine machining and the finishing of the individual components, as well as the assembly of the screw-type compressor 10.

Figure 5:
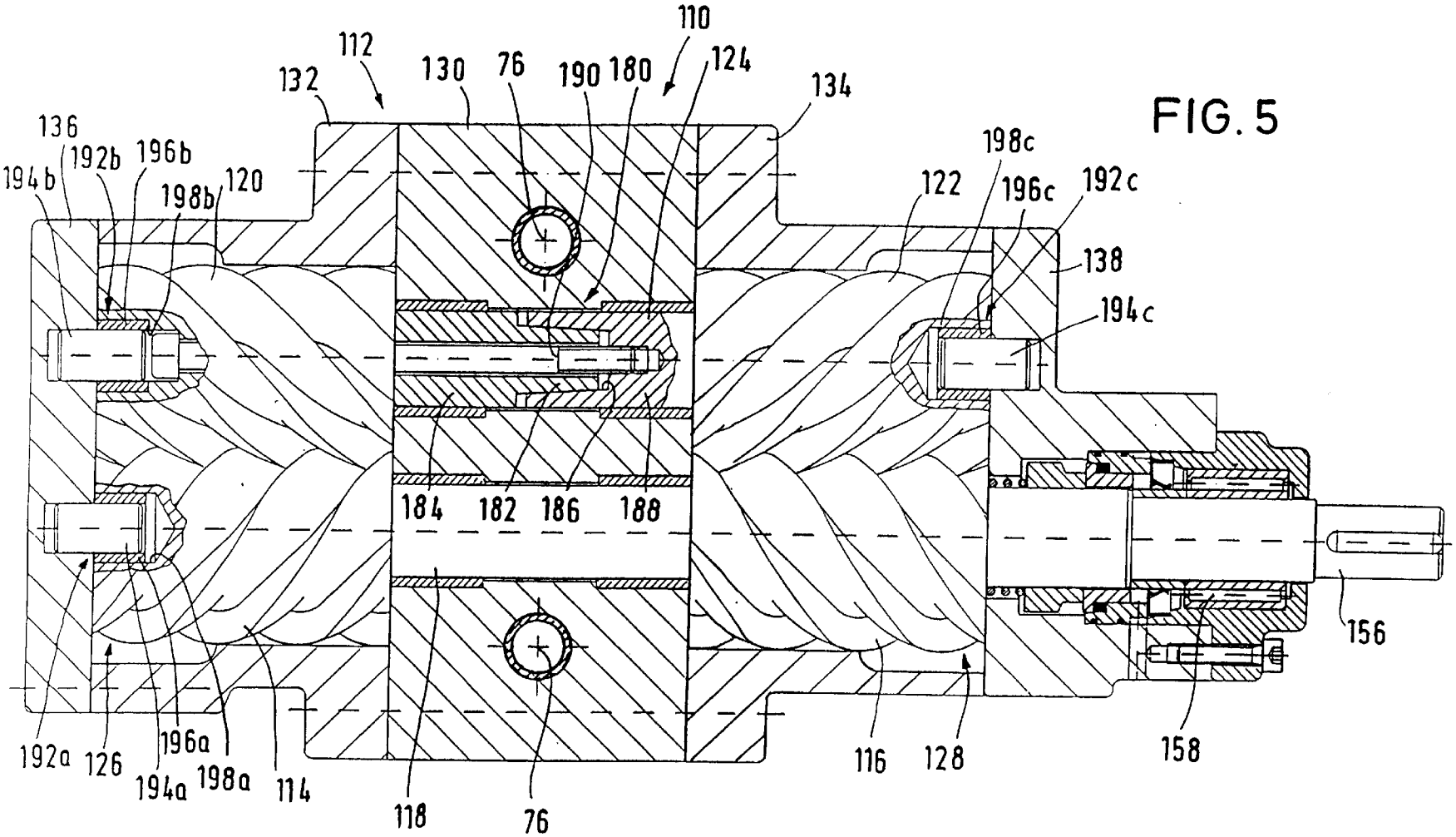
FIG. 5 is a sectional view corresponding to FIG. 2, showing a second embodiment of a screw-type compressor of the present invention.

The second embodiment of the screw-type compressor 110 illustrated in FIG. 5 differs from the first embodiment of the screw-type compressor 10 only in a few details. Elements corresponding to elements of the first embodiment are therefore designated by a reference numeral incremented by 100 with regard to the corresponding reference numeral in the FIGS. 1 to 4. For the description of these elements, reference should be made to the description of the first embodiment.

As in the first embodiment, the primary rotors 114, 116 and the secondary rotors 120, 122 of the second embodiment are firmly connected with a primary rotor assembly shaft 118 and a secondary rotor assembly shaft 124. However, other than in the first embodiment, the secondary rotor assembly shaft 124 has an adjusting device 180 for adjusting the axial distance between the secondary rotors 120, 122. The adjusting device 180 is designed such within the secondary rotor assembly shaft 124 that a conical projection 182 of a first secondary rotor assembly subshaft 184 extends into a conical recess 186 of a second secondary rotor assembly subshaft 188. The two independent secondary rotor assembly subshafts 184, 188 are connected by means of a tensioning screw 190 extending in the axial direction of the secondary rotor assembly subshafts and together form the secondary rotor assembly shaft 124.

In order to adjust the distance between the two secondary rotors 120, 122 such that they mesh with their respective primary rotor 114, 116 with as little wear as possible, The two secondary rotor assembly subshafts 184, 188 are assembled to one another. Subsequently, the distance of the two secondary rotors 120, 122 is adjusted by manipulating the tensioning screw 190. By finishing the front end faces of the secondary rotors 120, 122, the secondary rotors are adapted to the housing 12.

As an alternative to the adjusting device 180 illustrated, one may also provide an adjusting means, wherein the two secondary rotor assembly subshafts have superposed cylindrical sections. The distance between the secondary rotors can then be adjusted by means of a tensioning screw and interposed disk springs.

Different from the first embodiment of the screw-type compressor 10, the second embodiment of the screw-type compressor 110 further has additional shaft bearings 192*a* to 192*c* arranged at the front ends of the secondary rotors 120, 122 facing towards the end covers 136, 138 and at a front end of the primary rotor 114 facing towards the end cover 136. The shaft bearings 192*a* to 192*c* each have a circular cylindrical bearing pin 194*a* to 194*c* fixed in the respective end cover 136, 138, the pin engaging into a bearing bushing 196*a* to 196*c* rotating together with the respective rotor. The bearing bushings 196*a* to 196*c* are in turn arranged in bearing openings 198*a* to 198*c* which are cylindrical recesses, the bushings being in press fit and end flush with the respective end face at the front end of the respective primary rotor and secondary rotor 114, 120, 122. By providing the bearing bushings 196*a* to 196*b* in the rotors 114, 120, 122, the structural length of the screw-type compressor is reduced.

The screw-type compressor 10 of the first embodiment is adapted to generate pressures up to about 13 bar, despite the cantilevered bearing of the rotors 14, 20, 22. If, however, the front ends of the rotors 14, 16, 20, 22; 114, 116, 120, 122 facing towards the end covers are supported, pressures of up to 20 bar may be generated even at single-stage operation and with water injection. Together with the injection of water that counteracts the generation of heat, water lubrication of the bearings is provided independent of the concrete design of the screw-type compressor. However, water and oil lubrication are interchangeable.

Although a preferred embodiment of the invention has been specifically illustrated and described herein, it is to be understood that minor variations may be made in the apparatus without departing from the spirit and scope of the invention, as defined the appended claims.

I claim:

1. A screw-type compressor comprising a primary rotor assembly shaft (118) carrying at least a first primary rotor (114) and a second primary rotor (116), a secondary rotor assembly shaft (24, 124) carrying at least a first secondary rotor (120) and a second secondary rotor (122), said first primary rotor (114) being in substantially meshed relationship with said first secondary rotor (120), said second primary rotor (116) being in substantially meshed relationship with said second secondary rotor (122), said primary rotors (114, 116) being axially spaced from each other, said secondary rotors (120, 122) being axially spaced from each other, means (130) for supporting the primary rotor assembly shaft (118) and the secondary rotor assembly shaft (124) in an area between the primary rotors (114, 116) and the secondary rotors (120, 122), and at least one of said primary rotor assembly shaft (118) and said secondary rotor assembly shaft (124) including means (180) for adjusting the axial distance of at least one of said primary rotors (114, 116) and said secondary rotors (120, 122) relative to each other.

2. The screw-type compressor as defined in claim 1 wherein said adjusting means (180) adjust the axial distance of said secondary rotors (120, 122) relative to each other.

3. The screw-type compressor as defined in claim 1 wherein the first primary rotor (114) forms a first compressor stage (126) with the first secondary rotor (120), the second primary rotor (116) forms a second compressor stage (128) with the secondary rotor (122), and a partitioning wall (130) is disposed between the two compressor stages (126, 128).

4. The screw-type compressor as defined in claim 1 wherein the first primary rotor (114) forms a first compressor stage (126) with the first secondary rotor (120), the second primary rotor (116) forms a second compressor stage (128) with the secondary rotor (122), a partitioning wall (130) is disposed between the two compressor stages (126, 128), and means for conducting the pressure medium which is to be compressed to the first compressor stage (126) and subsequently to the second compressor stage (128).

5. The screw-type compressor as defined in claim 1 wherein the first primary rotor (114) forms a first compressor stage (126) with the first secondary rotor (120), the second primary rotor (116) forms a second compressor stage (128) with the secondary rotor (122), a partitioning wall (130) is disposed between the two compressor stages (126, 128), and means for conducting the pressure medium which is to be compressed through the first and second compressor stages (126, 128) in two substantially parallel flow paths.

6. The screw-type compressor as defined in claim 1, wherein at least one of said primary rotor assembly shaft (118) and said secondary rotor assembly shaft (124) include separate relatively axially movable subshafts (184, 188), and said adjusting means (180) is constructed and arranged to axially move said subshafts relative to each other to adjust said axial distance.

7. The screw-type compressor as defined in claim 1 wherein said secondary rotor assembly shaft (124) includes separate relatively axially movable subshafts (184, 188), and said adjusting means (180) is constructed and arranged to axially move said subshafts relative to each other to adjust said axial distance.

8. The screw-type compressor as defined in claim 6 wherein said adjusting means (180) is a screw.

9. The screw-type compressor as defined in claim 6 wherein said adjusting means (180) is a screw movable in coaxial relationship to an axis of said subshafts (184, 188).

10. The screw-type compressor as defined in claim 6 wherein said adjusting means (180) is a screw movable in coaxial relationship to an axis of said subshafts (184, 188), and said screw is accessible for manipulation through a bore in one of said rotors.

11. The screw-type compressor as defined in claim 1 wherein said subshafts (184, 188) are defined by a conical projection (182) received in a conical recess (186).

12. The screw-type compressor as defined in claim 8 wherein said subshafts (184, 188) are defined by a conical projection (182) received in a conical recess (186).

13. The screw-type compressor as defined in claim 9 wherein said subshafts (184, 188) are defined by a conical projection (182) received in a conical recess (186).

14. The screw-type compressor as defined in claim 7 wherein said adjusting means (180) is a screw.

15. The screw-type compressor as defined in claim 7 wherein said adjusting means (180) is a screw movable in coaxial relationship to an axis of said subshafts (184, 188).

16. The screw-type compressor as defined in claim 7 wherein said adjusting means (180) is a screw movable in coaxial relationship to an axis of said subshafts (184, 188), and said screw is accessible for manipulation through a bore in one of said rotors.

17. The screw-type compressor of claim 1 characterized in that both secondary rotors (120, 122) and one of the primary rotors (114) each have an outer end face provided with a bearing opening **(198*a*–198*c*) for receiving a bearing bushing (196*a*–196*c*)**.

18. The screw-type compressor of claim 1, characterized in that a compressed medium is discharged in the axial direction of the primary rotors and the secondary rotors (114, 116, 120, 122).

19. The screw-type compressor of claim 1 characterized in that the rotor geometries of the primary rotors (114, 116) are constructed and arranged such that axially directed pressure gas forces of both primary rotors (114, 116) compensate each other at least partly.

20. The screw-type compressor of claim 1 characterized in that the rotor geometries of the primary rotors (114, 116) are constructed and arranged such that axially directed pressure gas forces of both primary rotors (114, 116) compensate each other completely.

21. The screw-type compressor of claim 1, characterized in that the rotor geometries of the secondary rotors (120, 122) are constructed and arranged such that axially directed pressure gas forces of both secondary rotors (120, 122) compensate each other at least partly.

22. The screw-type compressor of claim 1 characterized in that the rotor geometries of the secondary rotors (120, 122) are constructed and arranged such that axially directed pressure gas forces of both secondary rotors (120, 122) compensate each other completely.

23. The screw-type compressor of claim 20 characterized in that the primary rotor (114) and the second primary rotor (116) have mirror symmetric geometries.

24. The screw-type compressor of claim 23, characterized in that the first and second primary rotors (114, 116) are arranged on the primary rotor assembly shaft (118) without mutual angular offset so that in the course of time the pressure at the first primary rotor (114) is identical with that at the second primary rotor (116).

* * * * *